US006910467B2

(12) United States Patent
Murakami et al.

(10) Patent No.: US 6,910,467 B2
(45) Date of Patent: Jun. 28, 2005

(54) EVAPORATED FUEL PROCESSING APPARATUSES FOR ENGINES WITH SUPERCHARGER

(75) Inventors: Kenichi Murakami, Obu (JP); Takashi Nagai, Obu (JP); Satomi Wada, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 10/845,165

(22) Filed: May 14, 2004

(65) Prior Publication Data

US 2004/0237946 A1 Dec. 2, 2004

(30) Foreign Application Priority Data

Jun. 2, 2003 (JP) ..... 2003-156086

(51) Int. Cl.[7] ..... F02M 33/02
(52) U.S. Cl. ..... 123/520; 123/383
(58) Field of Search ..... 123/516, 520, 123/521, 518, 519, 382, 383

(56) References Cited

U.S. PATENT DOCUMENTS 4,168,686 A * 9/1979 Wakita et al. ..... 123/521
4,308,842 A * 1/1982 Watanabe et al. ..... 123/520
5,005,550 A * 4/1991 Bugin et al. ..... 123/520
5,080,078 A * 1/1992 Hamburg ..... 123/521
5,183,023 A * 2/1993 Hanson ..... 123/520
5,190,015 A * 3/1993 Nakata et al. ..... 123/520
5,868,120 A * 2/1999 Van Wetten et al. ..... 123/518
6,257,209 B1 * 7/2001 Hyodo et al. ..... 123/520

FOREIGN PATENT DOCUMENTS

JP A 59-563 1/1984
JP A 62-18747 1/1987
JP A 5-10216 1/1993

* cited by examiner

*Primary Examiner*—Carl S. Miller
(74) *Attorney, Agent, or Firm*—Oliff & Berridge, PLC

(57) ABSTRACT

In an engine with a supercharger, there is provided an evaporated fuel processing apparatus for collecting vapor generated in a fuel tank into a canister and purging the collected vapor into an intake passage. The supercharger includes a compressor. The evaporated fuel processing apparatus comprises a purge passage through which the vapor is purged from the canister into the intake passage upstream of the compressor, a second purge passage through which the vapor is purged from the canister into a surge tank, two electromagnetic valves which are operated to open and close the two purge passage, various sensors which detect an operating condition of the engine, and an electronic control unit (ECU) which controls the electromagnetic valves respectively on the basis of values detected by the sensors.

16 Claims, 8 Drawing Sheets

EVAPORATED FUEL PROCESSING APPARATUSES FOR ENGINES WITH SUPERCHARGER

BACKGROUND OF THE INVENTION

1. Field of the Invention

The present invention relates to an evaporated fuel processing apparatus adapted to collect evaporated fuel generated in a fuel tank into a canister and then purge the collected evaporated fuel into an intake passage of an engine and, more particularly, to an evaporated fuel processing apparatus provided for an engine with a supercharger.

2. Description of Related Art

Some conventional arts related to an evaporated fuel processing apparatus for an engine with a supercharger are disclosed in for example the following patent documents; Patent document 1 (Japanese patent unexamined publication No. Sho 62-18747, particularly, pages 1-2 and FIG. 2), Patent document 2 (Japanese patent publication No. Sho 59-563, particularly, pages 1–3 and FIG. 2), and Patent document 3 (Japanese patent publication No. Hei 5-10216, particularly, pages 2–7 and FIGS. 1 and 5).

Patent Document 1 discloses an apparatus constructed to purge evaporated fuel collected in a canister into an intake passage by utilizing purge passages configured in a double purging system in response to operation/nonoperation of a supercharger. During supercharging that the pressure in an intake passage positioned downstream of a throttle valve (a restriction valve) is a positive pressure, a change-over valve is opened to purge evaporated fuel from the canister into the intake passage located upstream of a supercharging impeller. The change-over valve is a diaphragm type valve which opens when senses pressure in the intake passage located downstream of the throttle valve during supercharging.

Patent document 2 discloses an apparatus using purge passages configured in a double purging system, as with the apparatus in the document 1. Specifically, This apparatus is provided with a first purge passage (a purge line) for purging evaporated fuel from a canister into an intake passage located downstream of a throttle valve (an intake air restriction valve) and a second purge passage for purging the evaporated fuel from the canister into an intake passage located upstream of a compressor in a turbocharger. In an operating condition of the turbocharger, the compressor feeds supercharged air into the canister to thereby force the evaporated fuel out of the canister into the purge passage, thus purging the evaporated fuel into the intake passage upstream of the compressor. The second purge passage is provided with no valve or the like to control the flow of evaporated fuel.

Patent document 3 discloses an apparatus using purge passages configured in a double purging system, as with the apparatus in the documents 1 and 2. This apparatus is constructed, differently from that in the document 2, to take in air for purging evaporated fuel from an intake passage positioned upstream of a compressor in a turbocharger through an intake air introducing passage and introduce the air into a canister. In this apparatus, the purge passage for purging evaporated fuel into the intake passage located upstream of the compressor is provided with no valve or the like to control the flow of evaporated fuel.

In the apparatus of the document 1, however, since the change-over valve is a diaphragm type valve, a response delay in opening and closing the change-over valve would become problems as below. For example, when an engine is in a decelerating condition, fuel cut is generally performed in the engine. However, there may be cases where a supercharger operates by inertia even just after deceleration, causing a delay in opening the change-over valve. Accordingly, the evaporated fuel is caused to flow in the intake passage upstream of the supercharging impeller. The evaporated fuel at this time would not burn or incompletely burn in a combustion chamber, which results in a deterioration in exhaust gas. To avoid such problems, it is conceivable to provide a check-over valve in the purge passage. Since a negative pressure produced in the intake passage upstream of the supercharging impeller is relatively small, the pressure to open the check valve has to be set at a relatively small pressure. Consequently, the check valve tends to close later during deceleration of the engine and the evaporated fuel also may be caused to flow in the intake passage.

In the above documents 2 and 3, any valve or the like is not provided in the purge passage connected in communication with the intake passage upstream of the compressor. Accordingly, when the supercharger operates by inertia just after deceleration of the engine, the evaporated fuel is also caused to flow in the intake passage, leading to a deterioration in exhaust gas. To avoid such problems, a check valve may be provided in the purge passage. However, it can be hardly said that there is no possibility of causing a delay in closing the check valve during deceleration of the engine. This also may cause the evaporated fuel to flow in the intake passage.

SUMMARY OF THE INVENTION

The present invention has been made in view of the above circumstances and has an object to overcome the above problems and to provide an evaporated fuel processing apparatus for an engine with a supercharger, adapted to allow purging of evaporated fuel into an intake passage through the use of a negative pressure or supercharging pressure produced in the intake passage in association with operation of a supercharger and adapted to allow control of the purging in good response to operating conditions of the engine.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided an evaporated fuel processing apparatus for an engine with a supercharger, for collecting evaporated fuel generated in a fuel tank into a canister and purging the collected evaporated fuel from the canister to an intake passage of the engine, the supercharger including a compressor provided in the intake passage, the evaporated fuel processing apparatus comprising: a purge passage through which the evaporated fuel is purged from the canister into the intake passage located upstream of the compressor; an electromagnetic valve for opening and closing the purge passage; operating condition detection means which detects an operating condition of the engine; and control means which controls the opening and closing operations of the electromagnetic valve so that the electromagnetic valve is opened when the control means determines that intake pressure of the engine is an atmospheric pressure or more on the basis of the detected operating condition of the engine and the electromagnetic valve is closed when the control means determines that the intake pressure of the engine is less than the atmospheric pressure.

According to another aspect, the invention provides an evaporated fuel processing apparatus for an engine with a supercharger, for collecting evaporated fuel generated in a fuel tank into a canister and purging the collected evaporated fuel from the canister into an intake passage of the engine, the supercharger including a compressor provided in the intake passage, the evaporated fuel processing apparatus comprising: a first purge passage through which the evaporated fuel is purged from the canister into the intake passage located upstream of the compressor; a first electromagnetic valve for opening and closing the first purge passage; operating condition detection means which detects an operating condition of the engine; a throttle valve provided in the intake passage located downstream of the compressor; a second purge passage through which the evaporated fuel is purged from the canister into the intake passage located downstream of the throttle valve; a second electromagnetic valve for opening and closing the second purge passage; and control means which controls the opening and closing operations of the first and second electromagnetic valves so that the second electromagnetic valve is closed when the control means determines that intake pressure of the engine is an atmospheric pressure or more on the basis of the detected operating condition of the engine and then the first electromagnetic valve is opened, and the first and second electromagnetic valves are closed when the control means determines that the intake pressure of the engine is less than the atmospheric pressure.

According to another aspect, the invention provides an evaporated fuel processing apparatus for an engine with a supercharger, for collecting evaporated fuel generated in a fuel tank into a canister and purging the collected evaporated fuel from the canister to an intake passage of the engine, the supercharger including a compressor provided in the intake passage, the evaporated fuel processing apparatus comprising: a purge passage through which the evaporated fuel is purged from the canister into the intake passage located upstream of the compressor; a supercharging pressure passage through which a supercharging pressure in the intake passage downstream of the compressor is supplied to the canister as a back pressure; an electromagnetic valve for opening and closing the purge passage; operating condition detection means for detecting an operating condition of the engine; and control means which controls the opening and closing operations of the electromagnetic valve on the basis of the detected operating condition of the engine.

According to another aspect, the invention provides an evaporated fuel processing apparatus for an engine with a supercharger, for collecting evaporated fuel generated in a fuel tank into a canister and purging the collected evaporated fuel from the canister into an intake passage of the engine, the supercharger including a compressor provided in the intake passage, the evaporated fuel processing apparatus comprising: a purge passage through which the evaporated fuel is purged from the canister into the intake passage located upstream of the compressor; an aspirator, provided in the purge passage, for drawing in the evaporated fuel flowing through the purge passage by allowing working gas to flow; a supercharged air passage through which supercharged air in the intake passage downstream of the compressor is allowed to flow in the aspirator as the working gas; an electromagnetic valve for opening and closing the purge passage; operating condition detection means which detects an operating condition of the engine; and control means for controlling the opening and closing operations of the electromagnetic valve on the basis of the detected operating condition of the engine.

According to another aspect, the invention provides an evaporated fuel processing apparatus for an engine with a supercharger, for collecting evaporated fuel generated in a fuel tank into a canister and purging the collected evaporated fuel from the canister to an intake passage of the engine, the supercharger including a compressor provided in the intake passage, the evaporated fuel processing apparatus comprising: a purge passage through which the evaporated fuel is purged from the canister into the intake passage located downstream of the compressor; an aspirator, provided in the purge passage, for drawing in the evaporated fuel flowing through the purge passage by allowing working gas to flow; a supercharged air passage through which supercharged air in the intake passage downstream of the compressor is allowed to flow in the aspirator as the working gas; an electromagnetic valve for opening and closing the purge passage; operating condition detection means which detects an operating condition of the engine; and control means which controls the opening and closing operations of the electromagnetic valve on the basis of the detected operating condition of the engine.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

[First Embodiment]

A detailed description of a first preferred embodiment of an evaporated fuel processing apparatus for an engine with a supercharger embodying the present invention will now be given referring to the accompanying drawings.

Figure 1:
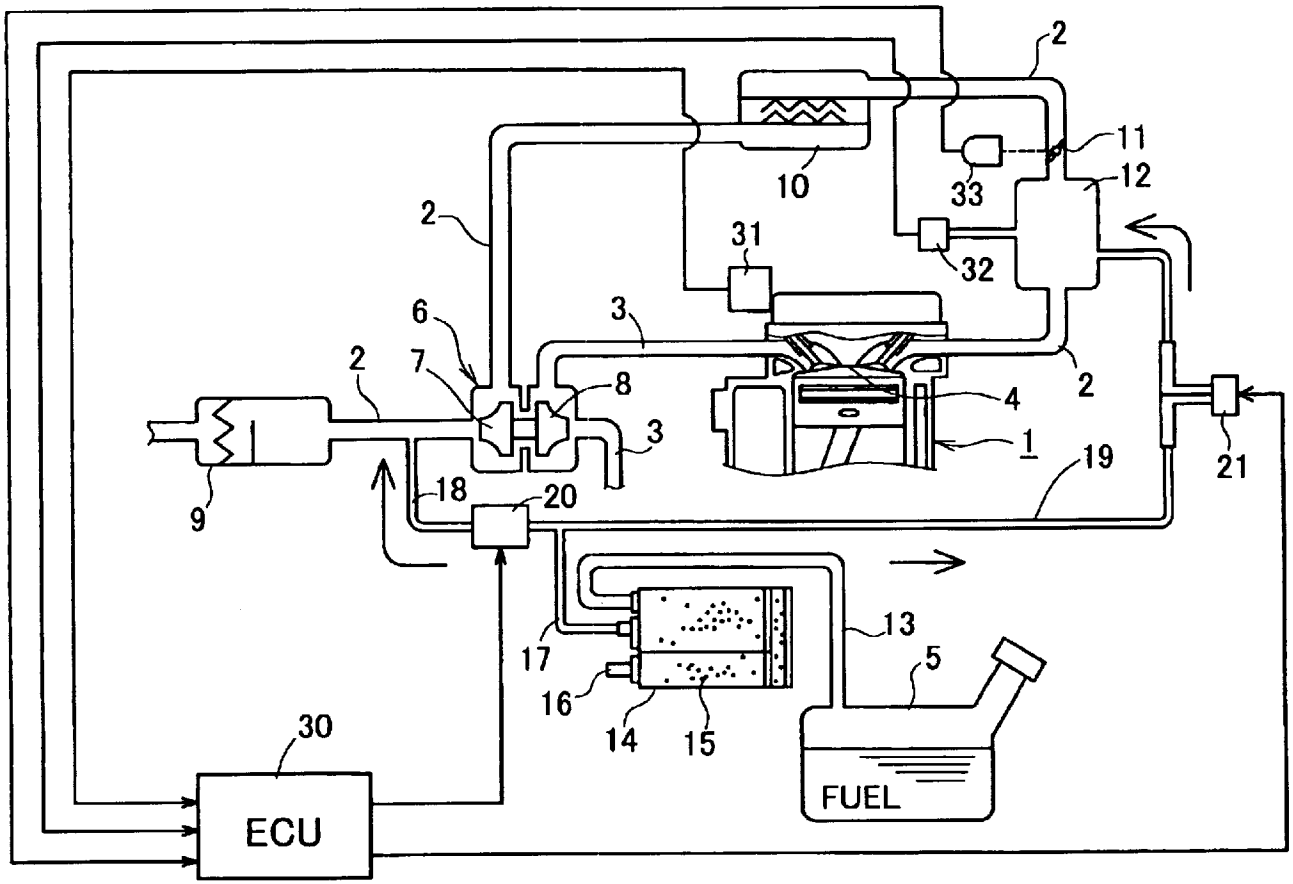
FIG. 1 is a schematic perspective view of an engine system with a supercharger in a first embodiment.

FIG. 1 is a schematic perspective view of an engine system with a supercharger in the present embodiment. An engine 1 is provided with an intake passage 2 for taking in outside air and an exhaust passage 3 for discharging exhaust gas. Fuel stored in a fuel tank 5 is supplied for combustion to a combustion chamber 4 of the engine 1 by a predetermined fuel supply device (not shown).

A turbocharger 6 serving as a supercharger is provided at a position of the intake passage 2 and the exhaust passage 3.

More specifically, a compressor 7 constituting the turbocharger 6 is disposed in the intake passage 2 and a turbine 8 also constituting the turbocharger 6 is disposed in the exhaust passage 3. As it is generally known, the turbocharger 6 is constructed such that the turbine 8 is rotated by power of exhaust gas, thereby rotating the compressor 7 disposed coaxially with the turbine 8, thus pressurizing (supercharging) the air in the intake passage 2. This supercharging causes the air of high density to be supplied to the combustion chamber 4 to burn a large amount of fuel, increasing power of the engine 1.

An air cleaner 9 is provided in the intake passage 2 upstream of the compressor 7. In the intake passage 2 downstream of the compressor 7, on the other hand, there are provided an intercooler 10, a throttle valve 11, and a surge tank 12. The intercooler 10 is used to cool supercharged air supplied via the compressor 7. The throttle valve 11 is opened and closed to control the amount of intake air. The throttle valve 11 is operated in interlocked relation with the operation of an accelerator pedal (not shown) by a driver. The surge tank 12 is used to smooth intake air involving pulsation.

The engine 1 is provided with a rotational speed sensor 31 for detecting the rotational speed (or engine rotational speed) NE of the engine 1. The surge tank 12 is provided with an intake pressure sensor 32 for detecting the pressure of intake air (or intake air pressure) PM. The throttle valve 11 is provided with a throttle sensor 33 for detecting an opening degree (throttle position) TA of the throttle valve 11. The throttle sensor 33 is also used as a switch for detecting a full closed position of the throttle valve 11. The rotational speed sensor 31, intake pressure sensor 32, and throttle sensor 33 constitute operating condition detection means of the present invention to detect an operating condition of the engine 1.

The evaporated fuel processing apparatus in the present embodiment is used to collect and process evaporated fuel (vapor) generated in the fuel tank 5 without discharging the vapor into atmosphere. The evaporated fuel processing apparatus includes a canister 14 for collecting or adsorbing the vapor generated in the fuel tank 5 through a vapor line 13. The canister 14 contains an adsorbent 15 made of activated charcoal.

The canister 14 has an atmospheric port 16 through which atmospheric air is allowed to enter the canister 14. A purge line 17 extending from the canister 14 branches at a point into a first purge line 18 and a second purge line 19. The first purge line 18 is connected in communication with the intake passage 2 upstream of the compressor 7. The second surge line 19 is connected with the surge tank 12. The purge line 17 and the first purge line 18 constitute a purge passage of the present invention to purge the vapor from the canister 14 into the intake passage 2 upstream of the compressor 7. The purge line 17 and the second purge line 19 constitute another purge passage of the present invention to purge the vapor from the canister 14 into the intake passage 2 downstream of the throttle valve 11. In the first purge line 18, a first electromagnetic valve 20 is provided as an electromagnetic valve of the present invention for opening and closing the line 18. In the second purge line 19, a second electromagnetic valve 21 is provided as another electromagnetic valve of the present invention for opening and closing the line 19.

The above evaporated fuel processing apparatus is constructed to collect the vapor generated in the fuel tank 5 into the canister 14 through the vapor line 13, and purge the collected vapor into the intake passage 2 through the purge line 17 and the first purge line 18 or the second purge line 19.

In the present embodiment, an electronic control unit (ECU) 30 is provided to control the engine 1 and the evaporated fuel processing apparatus. The rotational speed sensor 31, the intake pressure sensor 32, and the throttle sensor 33 are individually connected to the ECU 30. Similarly, the first and second electromagnetic valves 20 and 21 are individually connected to the ECU 30. To control the evaporated fuel processing apparatus in response to the operating condition of the engine 1, the ECU 30 controls the electromagnetic valves 20 and 21 respectively based on detection signals from the various sensors 31–33. The ECU 30 in the present embodiment corresponds to control means of the present invention.

The ECU 30 includes, as is generally known, a central processing unit (CPU), a read only memory (ROM), a random access memory (RAM), a backup RAM, an external input circuit and an external output circuit. The ROM previously stores a predetermined control program related to various controls including the purging control. The RAM temporarily stores calculation results from the CPU. The backup RAM saves the previously stored data. The CPU controls the electromagnetic valves 20 and 21 to execute the purging control using the evaporated fuel processing apparatus in response to detection signals that the CPU receives from the various sensors 31–33 through the input circuit.

Figure 2:
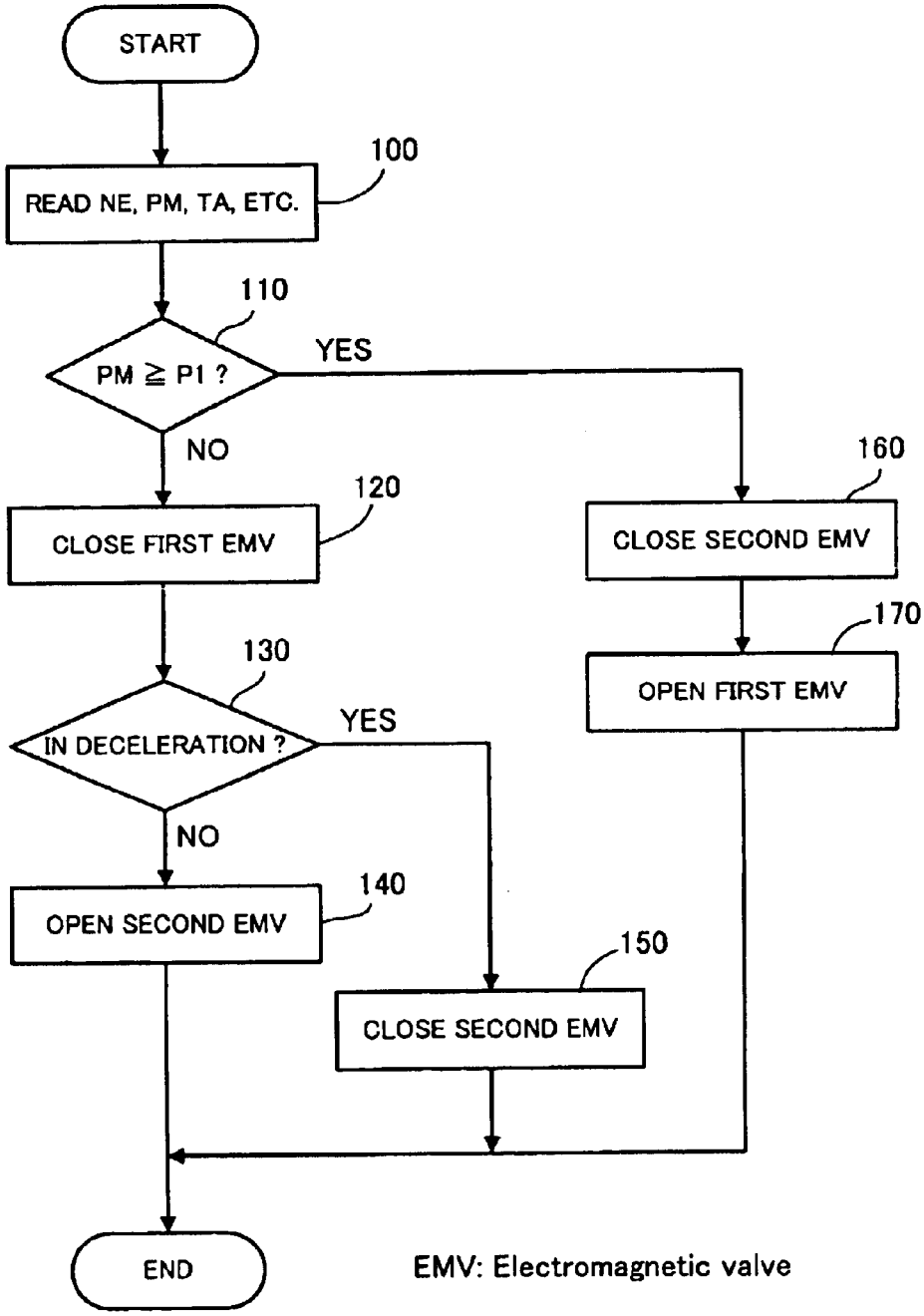
FIG. 2 is a flowchart showing a purge control program.

Next, explanation is made on processing details of the purging control that the ECU 30 executes. FIG. 2 is a flowchart of the purging control program. The ECU 30 periodically executes this routine at predetermined time intervals.

In step 100, the ECU 30 reads each detection value of the engine rotational speed NE, intake pressure PM, and throttle opening degree TA from the corresponding sensors 31 to 33.

In step 110, the ECU 30 determines whether the read intake pressure PM is an atmospheric pressure P1 or more. If a negative decision is made, the ECU 30 determined that the turbocharger 6 is not in operation and advances the flow to step 120.

In step 120, the ECU 30 stops the application of an electric current to the first electromagnetic valve 20 to close the valve 20, thereby closing the first purge line 18. This processing stops the mutual flow between the intake passage 2 upstream of the compressor 7 and the first purge line 18.

In step 130, the ECU 30 determines whether the engine 1 is in a decelerating condition. When the throttle sensor 33 detects a full closed position of the throttle valve 11, the ECU 30 determines that the engine 1 is in deceleration.

If a negative decision is made in step 130, the ECU 30 applies an electric current to the second electromagnetic valve 21 to open the valve 21, thereby opening the second purge line 19. The subsequent processing is temporarily terminated. When the purge line 19 is opened in this way, the vapor is purged from the canister 14 into the surge tank 12 by the negative pressure produced in the surge tank 12 during nonoperation of the turbocharger 6. In the present embodiment, for example, the second electromagnetic valve 21 may be operated under a duty control to differences in the intake pressure PM. This control makes it possible to control the amount of vapor to be purged into the surge tank 12.

If an affirmative decision is made in step 130, further, the ECU 30 stops the application of an electric current to the second electromagnetic valve 21 to close the valve 21, thereby closing the second purge line 19. This processing stops the purging of the vapor from the canister 14 into the surge tank 12.

If an affirmative decision is made in step 110, on the other hand, it is determined that the turbocharger 6 is in operation.

Thus, the ECU 30 advances the flow to step 160 to purge the vapor through the use of negative pressure produced in the intake passage 2 upstream of the compressor 7.

In step 160, the ECU 30 stops the application of an electric current to the second electromagnetic valve 21 to close the valve 21, thereby closing the second purge line 19. This processing makes it possible to stop the mutual flow between the surge tank 12 and the second purge line 19.

In step 170, the ECU 30 applies an electric current to the first electromagnetic valve 20 to open the valve 20, thereby opening the first purge line 18. When the purge line 18 is opened in this way, the vapor is purged from the canister 14 into the intake passage 2 upstream of the compressor 7 by the negative pressure produced in the intake passage 2 upstream of the compressor 7 during operation of the turbocharger 6.

According to the above structure in the present embodiment explained above, the pressure in the surge tank 12 becomes positive due to a supercharging pressure (the intake pressure PM becomes equal to or more than atmospheric pressure P1) during operation of the turbocharger 6. At this time, a negative pressure is caused in the intake passage 2 upstream of the compressor 7.

The opening/closing of the second electromagnetic valve 21 in the present embodiment is controlled by the ECU 30 according to the intake pressure PM representing the operating condition of the engine 1. In other words, when the intake pressure PM becomes less than the atmospheric pressure P1 in association with the operation of the turbocharger 6, the second electromagnetic valve 21 is immediately closed, thereby promptly interrupting the purging of vapor through the purge line 17 and the second purge line 19. Accordingly, during operation of the turbocharger 6, the supercharging pressure in the intake passage 2 downstream of the compressor 7 is prevented from improperly acting on the canister 14 through the second purge line 19 and others. It is thus possible to prevent a reduction in the efficiency of the vapor purging simultaneously executed with respect to the intake passage 2 upstream of the compressor 7.

At this time, the opening/closing of the first electromagnetic valve 20 is controlled by the ECU 30 on the basis of the intake pressure PM as above. In other words, when the intake pressure PM becomes equal to or more than the atmospheric pressure P1 in association with the operation of the turbocharger 6, the first electromagnetic valve 20 is opened immediately after the second electromagnetic valve 21 is closed. The vapor is thus drawn and promptly purged by the negative pressure from the canister 14 into the intake passage 2 upstream of the compressor 7 through the purge line 17 and the first purge line 18. In association with the operation of the turbocharger 6, accordingly, the vapor collected in the canister 14 can efficiently be purged into the intake passage 2 upstream of the compressor 7 by the negative pressure produced in the intake passage 2 upstream of the compressor 7.

During nonoperation of the turbocharger 6, on the other hand, a negative pressure is caused in the surge tank 12 (the intake pressure PM becomes less than the atmospheric pressure P1), and a slight negative pressure resulting from the flow of a small amount of intake air is produced in the intake passage 2 upstream of the compressor 7.

At this time, the first electromagnetic valve 20 is immediately closed, thereby promptly interrupting the purging of vapor through the first purge line 18 and others. Accordingly, during nonoperation of the turbocharger 6, the positive pressure in the intake passage 2 upstream of the compressor 7 is prevented from improperly acting on the canister 14 through the first purge line 18 and etc. It is therefore possible to prevent a reduction in the efficiency of the vapor purging simultaneously executed with respect to the surge tank 12.

During deceleration of the engine 1, a negative pressure is produced in the surge tank 12. At this time, the second electromagnetic valve 21 is immediately closed, thus promptly interrupting the vapor purging through the second purge line 19 and others. During deceleration of the engine 1, therefore, the collected vapor in the canister 14 will not improperly be purged into the intake passage 2 or drawn into the combustion chamber 4. This makes it possible to prevent the unburned vapor from deteriorating exhaust gas of the engine 1.

When the engine 1 is not during deceleration, on the other hand, the second electromagnetic valve 21 is immediately opened, promptly allowing the vapor purging through the second purge line 19 and others. During nonoperation of the turbocharger 6, the collected vapor in the canister 14 can efficiently purged by the negative pressure produced in the surge tank 12.

According to the evaporated fuel processing apparatus in the present embodiment, in association with the operation of the turbocharger 6, the vapor can be purged into the intake pressure 2 upstream of the compressor 7 by the action of the negative pressure produced in the intake pressure 2 upstream of the compressor 7. Further, the purging operation can be controlled in good response to the operating condition of the engine 1.

According to the evaporated fuel processing apparatus in the present embodiment, during nonoperation of the turbocharger 6, a negative pressure is produced in the surge tank 12. At this time, the second electromagnetic valve 21 is opened and the vapor collected in the canister 14 is drawn by the action of the above negative pressure into the surge tank 12 through the second purge line 19 and others. Thus, the vapor is purged from the canister 14. During operation of the turbocharger 6, on the other hand, a negative pressure is produced in the intake passage 2 upstream of the compressor 7. At this time, the first electromagnetic valve 20 is opened and, by the above negative pressure, the vapor collected in the canister 14 can be drawn and purged into the intake passage 2 upstream of the compressor 7 through the first purge line 18 and others. Accordingly, the vapor purging can be achieved through two purge lines, that is, through the second purge line 19 and others during nonoperation of the turbocharger 6 and through the first purge line 18 and others during operation of the turbocharger 6, respectively. Thus, the above apparatus can be used as an evaporated fuel processing apparatus equipped in an engine system with the turbocharger 6 to purge the vapor collected in the canister 14 regardless of operation/nonoperation of the turbocharger 6. It is therefore possible to increase the number of purgings, thereby increasing the capacity of the canister 14 to collect vapor. In proportion to the increase in the vapor collecting capacity, the canister 14 can be made smaller in size correspondingly.

According to the evaporated fuel processing apparatus in the present embodiment, on the basis of the intake pressure PM and the operating condition of the engine 1, i.e., whether the engine 1 is in deceleration or not, the purging is performed through the above two purge lines 18 and 19 and others. Consequently, regardless of operation/nonoperation of the turbocharger 6, the vapor can be efficiently burned in the combustion chamber 4. Furthermore, it is possible to prevent the unburned vapor from deteriorating exhaust gas during deceleration of the engine 1.

[Second Embodiment]

Next, a second preferred embodiment of the evaporated fuel processing apparatus for an engine with a supercharger will be described with reference to attached drawings.

It is to be noted that in the second and subsequent embodiments, like elements corresponding to those in the first embodiment are indicated by like numerals and their explanations are omitted. The following embodiments will be explained with a focus on different structures from those in the first embodiment.

Figure 3:
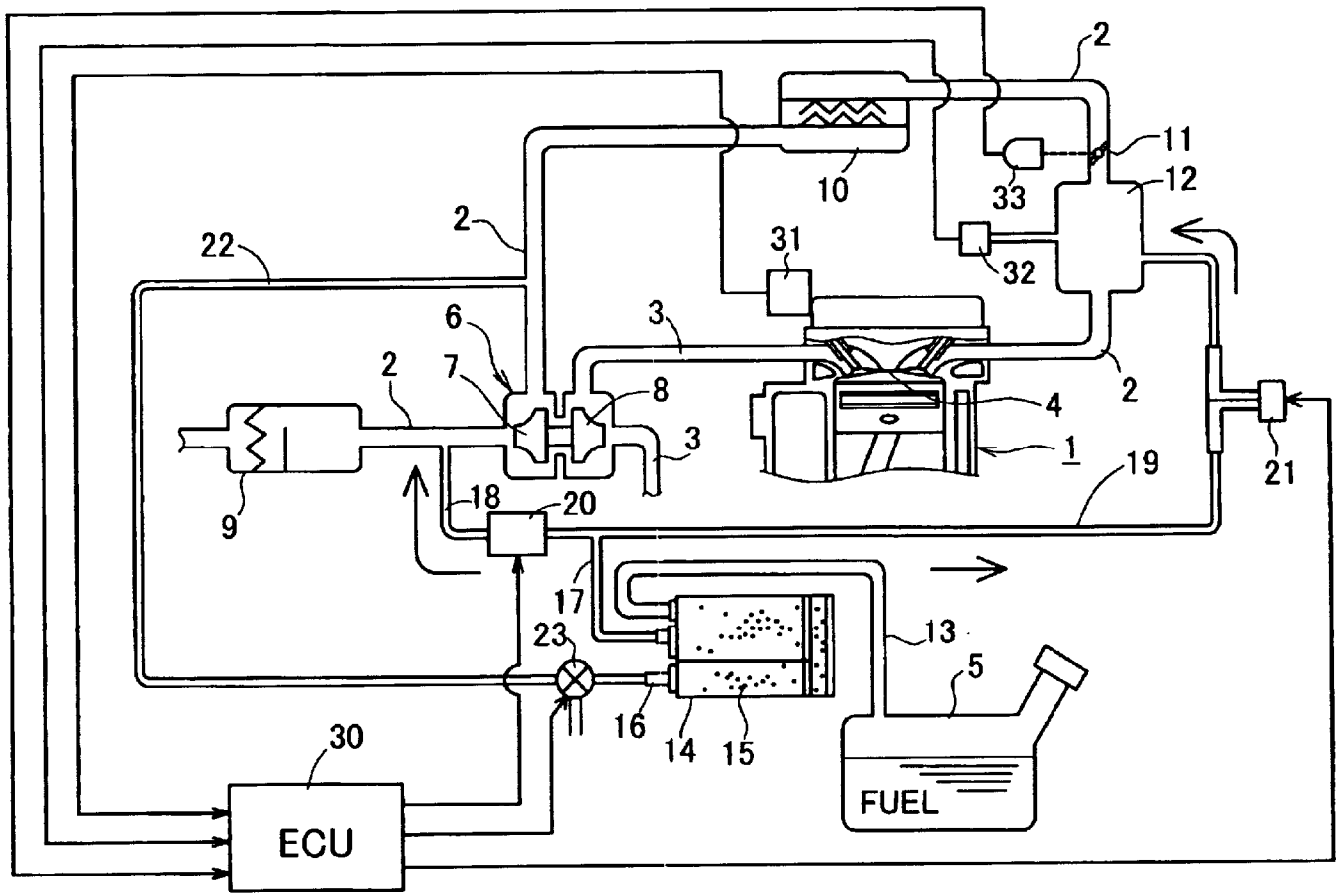
FIG. 3 is a schematic perspective view of an engine system with a supercharger in a second embodiment.

FIG. 3 is a schematic perspective view of an engine system with a supercharger in the second embodiment. The evaporated fuel processing apparatus in this embodiment differs from that in the first embodiment in that the apparatus in the second embodiment further includes a supercharging pressure passage 22 through which a supercharging pressure in the intake passage 2 downstream of the compressor 7 is supplied as a back pressure to the canister 14 and a third electromagnetic valve 23 in the passage 22.

More specifically, an end of the supercharging pressure passage 22 is connected in communication with the intake passage 2 downstream of the compressor 7 and the other end is connected with the atmospheric port 16 of the canister 14. The third electromagnetic valve 23 is constructed of a three-way change-over valve, which can be switched between a supercharging pressure introducing state for bringing the canister 14 into communication with the supercharging pressure passage 22 and an atmospheric discharging state for bringing the canister 14 in communication with atmospheric air.

Figure 4:
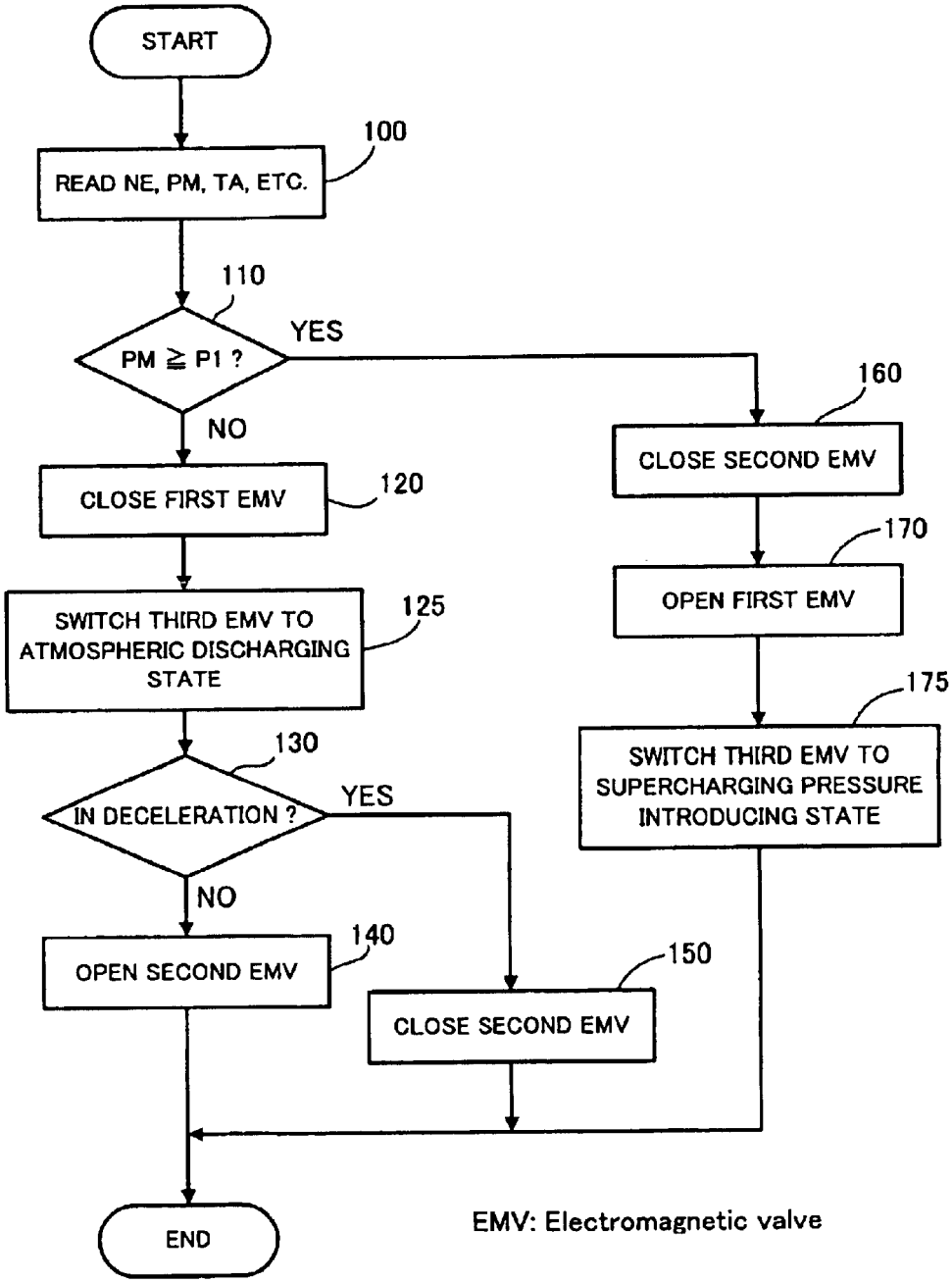
FIG. 4 is a flowchart showing a purge control program.

FIG. 4 is a flowchart of a purging control program in the second embodiment. The flowchart of FIG. 4 are different from that of FIG. 2 in that step 125 and step 175 are added after step 120 and steps 175 respectively.

In this routine, specifically, the ECU 30 closes the first electromagnetic valve 20 in step 120 and, after that, switches the third electromagnetic valve 23 into the atmospheric discharging state in step 125 to open the atmospheric port 16 of the canister 14 to atmospheric air.

Further, in this routine, the ECU 30 opens the first electromagnetic valve 20 in step 170 and, after that, switches the third electromagnetic valve 23 into the supercharging pressure introducing state to introduce the supercharging pressure as a back pressure into the canister 14.

According to the evaporated fuel processing apparatus in the second embodiment described above, a supercharging pressure is formed in the intake passage 2 downstream of the compressor 7 during operation of the turbocharger 6. At this time, when the first electromagnetic valve 20 is opened, the vapor collected in the canister 14 is drawn by the action of the above negative pressure into the intake passage 2 upstream of the compressor 7 through the first purge line 18 and others. Simultaneously, the third electromagnetic valve 23 is switched into the supercharging pressure introducing state to supply the supercharging pressure produced in the intake passage 2 downstream of the compressor 7, as a back pressure, to the canister 14 through the supercharging pressure passage 22. This back pressure forces the vapor out of the canister 14 into the first purge line 18 and others. In this way, by cooperation of the drawing by the negative pressure produced in the intake passage upstream of the compressor and the forced flow by the supercharging pressure, the vapor collected in the canister 14 is purged into the intake passage upstream of the compressor. Thus, as compared with the apparatus in the first embodiment, the apparatus in the second embodiment can more efficiently achieve the vapor purging to the intake passage upstream of the compressor by the amount of vapor forced out of the canister 14 by the supercharging pressure.

In the second embodiment, on the other hand, during nonoperation of the turbocharger 6, the third electromagnetic valve 23 is switched into the atmospheric discharging state. Accordingly, unnecessary intake pressure and supercharging pressure will not act on the canister 14 while the vapor is purged into the surge tank 12.

Other functions and effects that the evaporated fuel processing apparatus in the present embodiment can bring about are similar to those in the first embodiment.

[Third Embodiment]

Next, a third preferred embodiment of the evaporated fuel processing apparatus for an engine with a supercharger will be described with reference to attached drawings.

Figure 5:
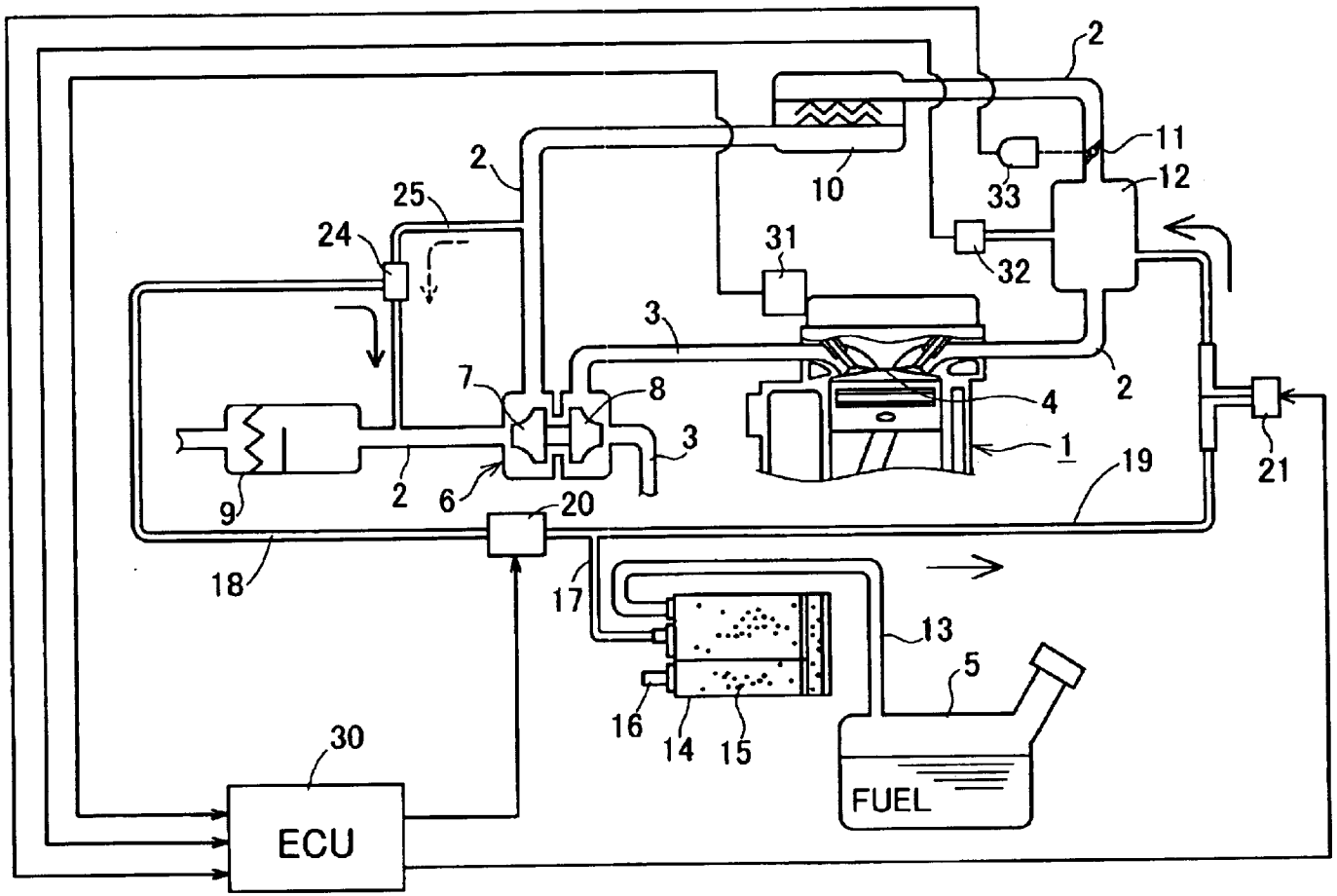
FIG. 5 is a schematic perspective view of an engine system with a supercharger in a third embodiment.

FIG. 5 is a schematic perspective view of an engine system with a supercharger in the present embodiment, which differs from that in the first embodiment in that the system in the third embodiment includes an aspirator 24 which allows working gas to flow to thereby draw in the vapor flowing through the first purge line 18, and a passage 25 for supplying supercharged air from the intake passage 2 downstream of the compressor 7 to the aspirator 24 as the working gas.

Specifically, one end (i.e., an upstream end) of the supercharged air passage 25 is connected in communication with the intake passage 2 downstream of the compressor 7 and the other end (i.e., a downstream end) is connected in communication with the aspirator 24. The aspirator 24 is adapted to allow the supercharged air to flow in from the passage 25 and thereby draw in the vapor from the first purge line 18 upstream of the aspirator 24 to cause the drawn vapor to flow in the line 18 downstream of the same.

In the present embodiment, the purge control program that the ECU 30 executes is the same as that shown in FIG. 2.

According to the evaporated fuel processing apparatus in the present embodiment, consequently, a supercharging pressure is produced in the intake passage 2 on the downstream side of the compressor 7 during operation of the turbocharger 6. At this time, the first electromagnetic valve 20 is opened, so that the vapor collected in the canister 14 is drawn by the above mentioned negative pressure into the intake passage 2 downstream of the compressor 7 via the first purge line 18. Simultaneously, the supercharged air in the intake passage 2 on the downstream side of the compressor 7 is caused to flow as the working gas in the aspirator 24 through the passage 25. The vapor flowing through the first purge line 18 is thus drawn in by the aspirator 24. In this manner, drawing by the negative pressure in the intake passage 2 on the upstream side of the compressor 7 and drawing by the aspirator 24 cooperate to purge the vapor collected in the canister 14 into the intake passage 2 upstream of the compressor 7. Accordingly, as compared with the apparatus in the first embodiment, the apparatus in the present embodiment can purge the vapor more efficiently into the intake passage 2 upstream of the compressor 7 by an amount of the vapor drawn in by the aspirator 24 from the first purge line 18.

Other functions and effects that the evaporated fuel processing apparatus in the present embodiment can bring about are similar to those in the first embodiment.

[Fourth Embodiment]

Next, a fourth preferred embodiment of the evaporated fuel processing apparatus for an engine with a supercharger will be described with reference to attached drawings.

Figure 6:
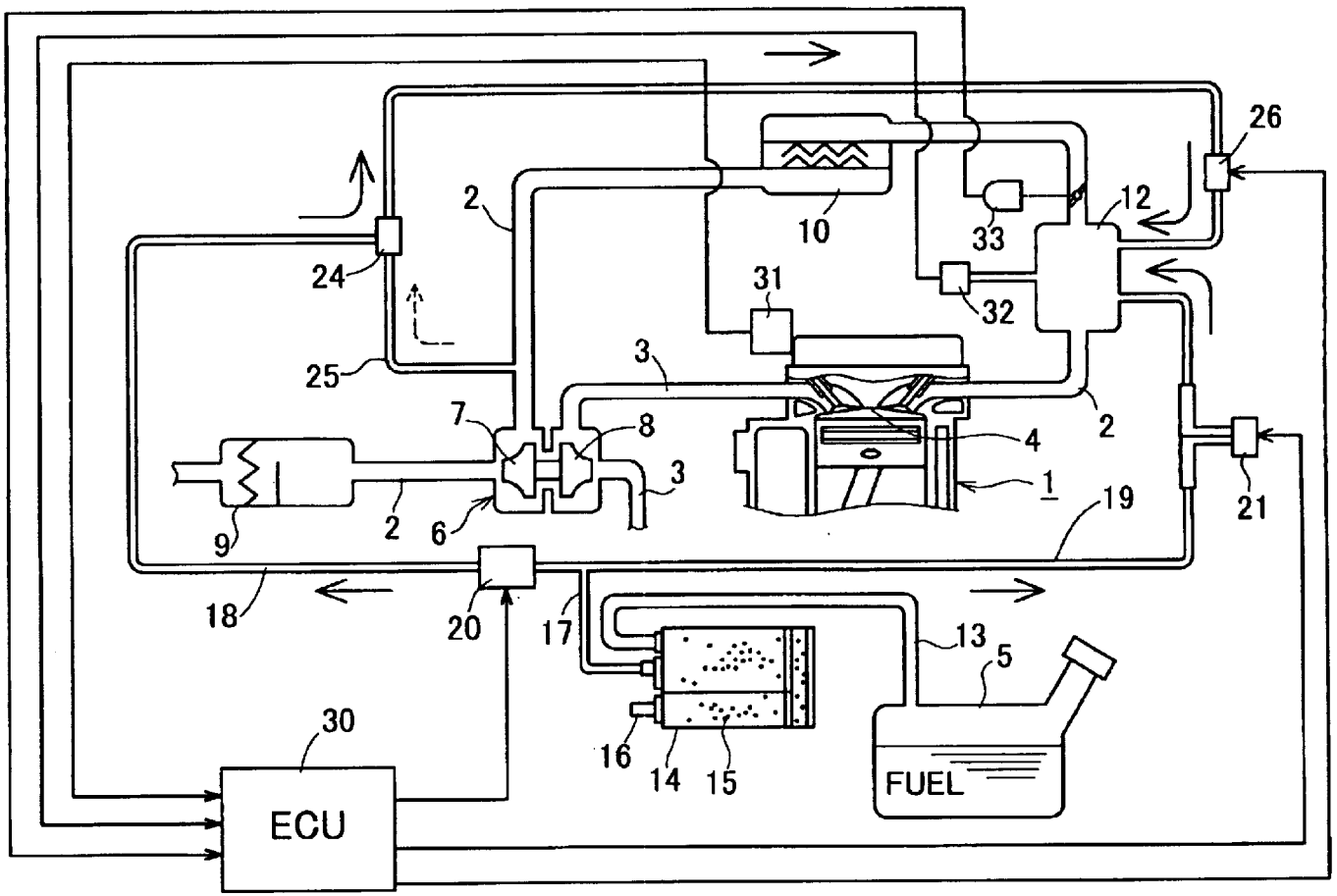
FIG. 6 is a schematic perspective view of an engine system with a supercharger in a fourth embodiment.

FIG. 6 is a schematic perspective view of an engine system with a supercharger in the present embodiment, which differs from that in the first embodiment in that the system in the fourth embodiment includes the first purge line 18 whose leading end (i.e., downstream end) is directly connected with the surge tank 12, an aspirator 24 which draws in the vapor flowing through the first purge line 18, a supercharged air passage 25 through which supercharged air is introduced from the intake passage 2 downstream of the compressor 7 into the aspirator 24, and a fourth electromagnetic valve 26 provided near the downstream end of the first purge line 18.

Specifically, one end of the supercharged air passage 25 is connected in communication with the intake passage 2 located downstream of the compressor 7 and the other end is connected in communication with the aspirator 24. The aspirator 24 is adapted to allow the supercharged air to flow in from the passage 25 and thereby draw in the vapor from the first purge line 18 upstream of the aspirator 24 to allow the drawn vapor to flow in the line 18 downstream of the same.

Figure 7:
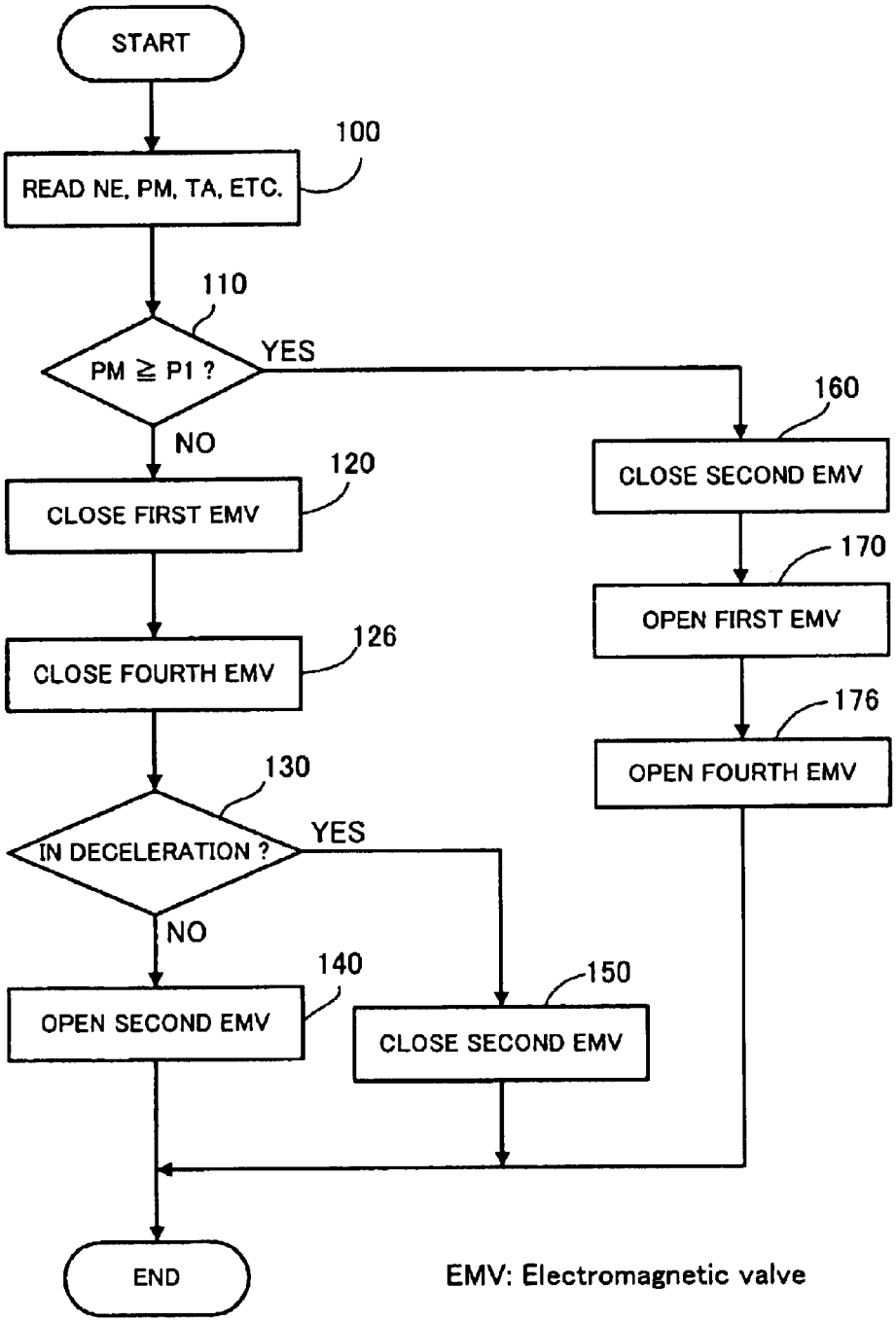
FIG. 7 is a flowchart showing a purge control program.

FIG. 7 is a flowchart of the purge control program in the present embodiment. The flowchart in FIG. 7 differs from that in FIG. 2 in that step 126 and step 176 are added after step 120 and step 170 respectively.

In this routine, the ECU 30 closes the first electromagnetic valve 20 in step 120 and stops the application of an electric current to the fourth electromagnetic valve 26 in step 126 to close the valve 26, thereby closing the first purge line 18.

In this routine, furthermore, the ECU 30 opens the first electromagnetic valve 20 in step 170 and applies an electric current to the fourth electromagnetic valve 26 in step 176 to open the valve 26, thereby opening the first purge line 18.

According to the evaporated fuel processing apparatus in the fourth embodiment described above, the supercharging pressure is produced in the intake passage 2 on the downstream side of the compressor 7 during operation of the turbocharger 6. When this supercharged air is caused to flow as working gas in the aspirator 24 through the supercharged air passage 25, a negative pressure acts on the first purge line 18. At this time, the first electromagnetic valve 20 and the fourth electromagnetic valve 26 are opened. By the above mentioned negative pressure, the vapor collected in the canister 14 is purged into the surge tank 12 through the first purge line 18. Thus, the apparatus in the present embodiment can purge the vapor to the surge tank 12 by utilizing the supercharging pressure (positive pressure) produced in the intake passage 2 downstream of the compressor 7 in association with the operation of the turbocharger 6.

In the present embodiment, on the other hand, the fourth electromagnetic valve 26 is closed during nonoperation of the turbocharger 6. Accordingly, when the vapor is purged to the surge tank 12 through the second purge line 19 and others, unnecessary intake pressure does not act on the surge tank through the first purge line 18 and others.

Other functions and effects that the evaporated fuel processing apparatus in the fourth embodiment can bring about are similar to those in the first embodiment.

[Fifth Embodiment]

Next, a fifth preferred embodiment of the evaporated fuel processing apparatus for an engine with a supercharger will be described with reference to attached drawings.

Figure 8:
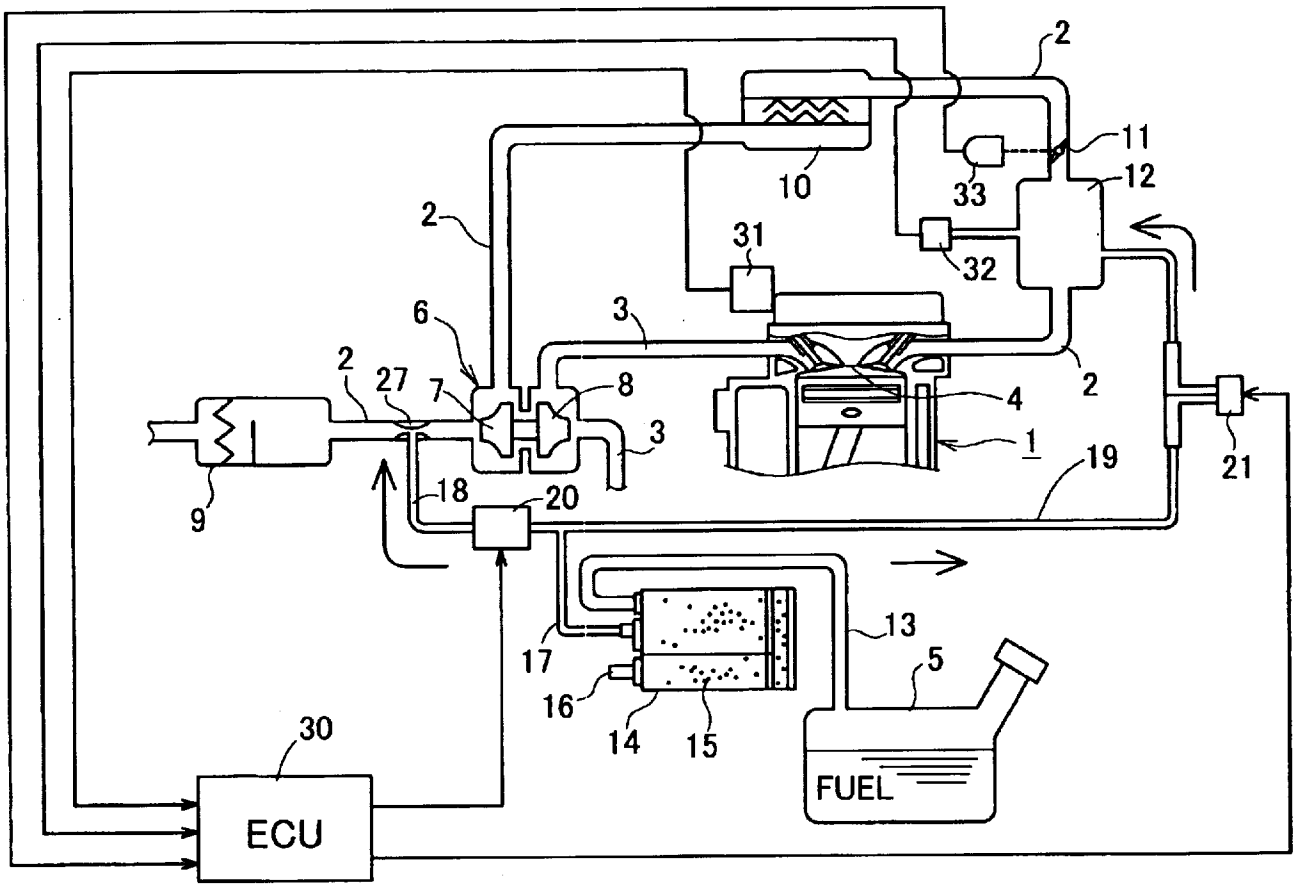
FIG. 8 is a schematic perspective view of an engine system with a supercharger in a fifth embodiment.

FIG. 8 is a schematic perspective view of an engine system with a supercharger in the present embodiment, which differs from that in the first embodiment in that the system in the fifth embodiment includes a venturi 27 at a connected portion of the intake passage 2 with the first purge line 18.

According to the evaporated fuel processing apparatus in the fifth embodiment, consequently, the venturi 27 disposed in the connected portion between the intake passage 2 and the first purge line 18 serves to increase the negative pressure in the intake passage 2 upstream of the compressor 7. This makes it possible to enhance the power of drawing the vapor from the first purge line 18 into the intake passage 2 upstream of the compressor 7. Accordingly, as compared with the apparatus in the first embodiment, the apparatus in the present embodiment can purge the vapor more efficiently to the intake passage 2 upstream of the compressor 7 by an amount corresponding to the enhanced drawing power.

The present invention may be embodied in other specific forms without departing from the spirit or essential characteristics thereof. For instance, the following designs may be adopted.

In each of the above embodiments, the evaporated fuel processing apparatus is provided with the purge passages configured in the double purging system including the second purge line 19 to be used during nonoperation of the turbocharger 6 and the first purge line 18 to be used during operation of the turbocharger 6. Instead of this configuration, a single purging system using only the first purge line 18 may be adopted. In this case, the second purge line 19 for nonoperation of the turbocharger 6 is omitted.

In each of the above embodiments, although the second electromagnetic valve 21 is disposed in the second purge line 19, this valve 21 may be omitted.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An evaporated fuel processing apparatus for an engine with a supercharger, for collecting evaporated fuel generated in a fuel tank into a canister and purging the collected evaporated fuel from the canister to an intake passage of the engine, the supercharger including a compressor provided in the intake passage, the evaporated fuel processing apparatus comprising:

a purge passage through which the evaporated fuel is purged from the canister into the intake passage located upstream of the compressor;

an electromagnetic valve for opening and closing the purge passage;

operating condition detection means which detects an operating condition of the engine; and control means which controls the opening and closing operations of the electromagnetic valve so that the electromagnetic valve is opened when the control means determines that intake pressure of the engine is an atmospheric pressure or more on the basis of the detected operating condition of the engine and the electromagnetic valve is closed when the control means determines that the intake pressure of the engine is less than the atmospheric pressure.

2. An evaporated fuel processing apparatus for an engine with a supercharger, for collecting evaporated fuel generated in a fuel tank into a canister and purging the collected evaporated fuel from the canister into an intake passage of the engine, the supercharger including a compressor provided in the intake passage, the evaporated fuel processing apparatus comprising:

a first purge passage through which the evaporated fuel is purged from the canister into the intake passage located upstream of the compressor;

a first electromagnetic valve for opening and closing the first purge passage;

operating condition detection means which detects an operating condition of the engine;

a throttle valve provided in the intake passage located downstream of the compressor;

a second purge passage through which the evaporated fuel is purged from the canister into the intake passage located downstream of the throttle valve;

a second electromagnetic valve for opening and closing the second purge passage; and control means which controls the opening and closing operations of the first and second electromagnetic valves so that the second electromagnetic valve is closed when the control means determines that intake pressure of the engine is an atmospheric pressure or more on the basis of the detected operating condition of the engine and then the first electromagnetic valve is opened, and the first and second electromagnetic valves are closed when the control means determines that the intake pressure of the engine is less than the atmospheric pressure.

3. An evaporated fuel processing apparatus for an engine with a supercharger, for collecting evaporated fuel generated in a fuel tank into a canister and purging the collected evaporated fuel from the canister to an intake passage of the engine, the supercharger including a compressor provided in the intake passage, the evaporated fuel processing apparatus comprising:

a purge passage through which the evaporated fuel is purged from the canister into the intake passage located upstream of the compressor;

a supercharging pressure passage through which a supercharging pressure in the intake passage downstream of the compressor is supplied to the canister as a back pressure;

an electromagnetic valve for opening and closing the purge passage;

a three-way change-over valve disposed in the supercharging pressure passage, the three-way change-over valve being switchable between a supercharging pressure introducing state in which the canister is brought into communication with the supercharging pressure passage and an atmospheric discharging state in which the canister is brought in communication with atmospheric air;

operating condition detection means for detecting an operating condition of the engine; and control means which controls the opening and closing operations of the electromagnetic valve and the three-way change-over valve on the basis of the detected operating condition of the engine.

4. An evaporated fuel processing apparatus for an engine with a supercharger, for collecting evaporated fuel generated in a fuel tank into a canister and purging the collected evaporated fuel from the canister into an intake passage of the engine, the supercharger including a compressor provided in the intake passage, the evaporated fuel processing apparatus comprising:

a purge passage through which the evaporated fuel is purged from the canister into the intake passage located upstream of the compressor;

an aspirator, provided in the purge passage, for drawing in the evaporated fuel flowing through the purge passage by allowing working gas to flow;

a supercharged air passage through which supercharged air in the intake passage downstream of the compressor is allowed to flow in the aspirator as the working gas;

an electromagnetic valve for opening and closing the purge passage;

operating condition detection means which detects an operating condition of the engine; and control means for controlling the opening and closing operations of the electromagnetic valve on the basis of the detected operating condition of the engine.

5. An evaporated fuel processing apparatus for an engine with a supercharger, for collecting evaporated fuel generated in a fuel tank into a canister and purging the collected evaporated fuel from the canister to an intake passage of the engine, the supercharger including a compressor provided in the intake passage, the evaporated fuel processing apparatus comprising:

a purge passage through which the evaporated fuel is purged from the canister into the intake passage located downstream of the compressor;

an aspirator, provided in the purge passage, for drawing in the evaporated fuel flowing through the purge passage by allowing working gas to flow;

a supercharged air passage through which supercharged air in the intake passage downstream of the compressor is allowed to flow in the aspirator as the working gas;

an electromagnetic valve for opening and closing the purge passage;

operating condition detection means which detects an operating condition of the engine; and control means which controls the opening and closing operations of the electromagnetic valve on the basis of the detected operating condition of the engine.

6. The evaporated fuel processing apparatus according to claim 1 further comprising a venturi placed at a connected portion between the purge passage and the intake passage.

7. The evaporated fuel processing apparatus according to claim 2 further comprising a venturi placed at a connected portion between the purge passage and the intake passage.

8. The evaporated fuel processing apparatus according to claim 3 further comprising:

a throttle valve provided in the intake passage downstream of the compressor; and a second purge passage through which the evaporated fuel is purged from the canister into the intake passage downstream of the throttle valve.

9. The evaporated fuel processing apparatus according to claim 4 further comprising:

a throttle valve provided in the intake passage downstream of the compressor; and a second purge passage through which the evaporated fuel is purged from the canister into the intake passage downstream of the throttle valve.

10. The evaporated fuel processing apparatus according to claim 5 further comprising:

a throttle valve provided in the intake passage downstream of the compressor; and a second purge passage through which the evaporated fuel is purged from the canister into the intake passage downstream of the throttle valve.

11. An evaporated fuel processing apparatus for an engine with a supercharger, for collecting evaporated fuel generated in a fuel tank into a canister and purging the collected evaporated fuel from the canister to an intake passage of the engine, the supercharger including a compressor provided in the intake passage, the evaporated fuel processing apparatus comprising:

a purge passage through which the evaporated fuel is purged from the canister into the intake passage located upstream of the compressor;

a supercharging pressure passage through which a supercharging pressure in the intake passage downstream of the compressor is supplied to the canister as a back pressure;

an electromagnetic valve for opening and closing the purge passage;

operating condition detection means for detecting an operating condition of the engine; and control means which controls the opening and closing operations of the electromagnetic valve on the basis of the detected operating condition of the engine, wherein the control means controls the opening and closing operations of the electromagnetic valve so that the electromagnetic valve is opened when the control means determines that intake pressure of the engine is an atmospheric pressure or more on the basis of the detected operating condition of the engine and the electromagnetic valve is closed when the control means determines that the intake pressure of the engine is less than the atmospheric pressure.

12. The evaporated fuel processing apparatus according to claim 4, wherein the control means controls the opening and closing operations of valve so that the electromagnetic valve is opened when the control means determines that intake pressure of the engine is an atmospheric pressure or more on the basis of the detected operating condition of the engine and the electromagnetic valve is closed when the control means determines that the intake pressure of the engine is less than the atmospheric pressure.

13. The evaporated fuel processing apparatus according to claim 5, wherein the control means controls the opening and closing operations of the electromagnetic valve so that the electromagnetic valve is opened when the control means determines that intake pressure of the engine is an atmospheric pressure or more on the basis of the detected operating condition of the engine and the electromagnetic valve is closed when the control means determines that the intake pressure of the engine is less than the atmospheric pressure.

14. The evaporated fuel processing apparatus according to claim 8, wherein the apparatus further comprises a second electromagnetic valve for opening and closing the second purge passage, and the control means controls the opening and closing operations of the first and second electromagnetic valves so that the second electromagnetic valve is closed when the control means determines that intake pressure of the engine is an atmospheric pressure or more on the basis of the detected operating condition of the engine and then the first electromagnetic valve is opened, and the first and second electromagnetic valves are closed when the control means determines that the intake pressure of the engine is less than the atmospheric pressure.

15. The evaporated fuel processing apparatus according to claim 9, wherein the apparatus further comprises a second electromagnetic valve for opening and closing the second purge passage, and the control means controls the opening and closing operations of the first and second electromagnetic valves so that the second electromagnetic valve is closed when the control means determines that intake pressure of the engine is an atmospheric pressure or more on the basis of the detected operating condition of the engine and then the first electromagnetic valve is opened, and the first and second electromagnetic valves are closed when the control means determines that the intake pressure of the engine is less than the atmospheric pressure.

16. The evaporated fuel processing apparatus according to claim 10, wherein the apparatus further comprises a second electromagnetic valve closing the second purge passage, and the control means controls the opening and closing operations of the first and second electromagnetic valves so that the second electromagnetic valve is closed when the control means determines that intake pressure of the engine is an atmospheric pressure or more on the basis of the detected operating condition of the engine and then the first electromagnetic valve is opened, and the first and second electromagnetic valves are closed when the control means determines that the intake pressure of the engine is less than the atmospheric pressure.

* * * * *